United States Patent [19]

Miller

[11] 4,336,434

[45] Jun. 22, 1982

[54] MICROWAVE OVEN CAVITY EXCITATION SYSTEM EMPLOYING CIRCULARLY POLARIZED BEAM STEERING FOR UNIFORMITY OF ENERGY DISTRIBUTION AND IMPROVED IMPEDANCE MATCHING

[75] Inventor: Matthew S. Miller, Louisville, Ky.

[73] Assignee: General Electric Company, Louisville, Ky.

[21] Appl. No.: 178,324

[22] Filed: Aug. 15, 1980

[51] Int. Cl.[3] ..... H05B 6/72

[52] U.S. Cl. ..... 219/10.55 F

[58] Field of Search ..... 219/10.55 F, 10.55 M, 219/10.55 R, 10.55 A

[56] References Cited

U.S. PATENT DOCUMENTS

| | | | |
|---|---|---|---|
| 3,210,511 | 10/1965 | Smith | 219/10.55 F |
| 3,364,332 | 1/1968 | Reftmark | 219/10.55 F |
| 3,373,259 | 3/1968 | Smith | 219/10.55 F |
| 3,430,022 | 2/1969 | Cougoule | 219/10.55 F |
| 3,437,777 | 4/1969 | Nagai et al. | 219/10.55 F |
| 3,439,143 | 4/1969 | Cougoule | 219/10.55 F |
| 3,471,671 | 10/1969 | Puschner | 219/10.55 F |
| 3,493,709 | 2/1970 | Lavoo et al. | 219/10.55 F |
| 3,739,130 | 6/1973 | White | 219/10.55 F |
| 3,742,177 | 6/1973 | Wikstrom et al. | 219/10.55 F |
| 3,745,292 | 7/1973 | Couasnard | 219/10.55 F |
| 3,953,702 | 4/1976 | Bickel | 219/10.55 R |
| 3,991,295 | 11/1976 | Akiyoshi | 219/10.55 F |
| 3,993,886 | 11/1976 | Imberg et al. | 219/10.55 F |
| 4,019,010 | 4/1977 | Tanaka et al. | 219/10.55 F |
| 4,079,221 | 3/1978 | McGillem et al. | 219/10.55 F |
| 4,099,042 | 7/1978 | Jean et al. | 219/10.55 F |
| 4,133,997 | 1/1979 | Thuleen | 219/10.55 F |
| 4,140,888 | 2/1979 | Baron | 219/10.55 F |
| 4,144,436 | 3/1979 | Hauck | 219/10.55 F |
| 4,144,437 | 3/1979 | Ehlers | 219/10.55 F |
| 4,160,144 | 7/1979 | Kashyap et al. | 219/10.55 A |
| 4,165,454 | 8/1979 | Carlsson et al. | 219/10.55 F |
| 4,176,266 | 11/1979 | Kaneko et al. | 219/10.55 F |

OTHER PUBLICATIONS

Simmons, A. I., *Circularly Polarized Slot Radiators,* IRE Trans. Antennas and Propagation, vol. AP-5, No. 1, Jan. 1957, pp. 31-36.

Sanford, G. G., *Conformal Microstrip Phased Array for Aircraft Tests with ATS-6,* IEEE Trans., vol. AP-26, No. 5, Sep. 1978, pp. 642-646.

Tech-Briefs No. 652, Digital Phase Shifters Trans-Tech. Inc. 3-27-78.

Tech-Brief No. 692, Digital Phase Shifters, Trans-Tech. Inc. 3-27-78.

*Primary Examiner*—Arthur T. Grimley

*Attorney, Agent, or Firm*—H. Neil Houser; Radford M. Reams

[57] ABSTRACT

A microwave oven cavity excitation system which introduces circularly-polarized electromagnetic wave energy into a cooking cavity through a plurality of feed points appropriately phased to provide a concentrated beam. The relative phasing of the feed points is varied as a function of time to steer the concentrated beam to sweep the interior of the cavity, improving the time-averaged energy distribution. One form of phase shift element disclosed is a dielectric vane rotated by airflow through a feed waveguide within which the dielectric vane is rotatably mounted. As a result of the circular polarization, standing waves in the direction of one of the cavity dimensions are minimized, and the amount of energy reflected back to the generator may be reduced.

14 Claims, 9 Drawing Figures

MICROWAVE OVEN CAVITY EXCITATION SYSTEM EMPLOYING CIRCULARLY POLARIZED BEAM STEERING FOR UNIFORMITY OF ENERGY DISTRIBUTION AND IMPROVED IMPEDANCE MATCHING

BACKGROUND OF THE INVENTION

The present invention relates generally to microwave oven cavity excitation systems and, more particularly, to microwave oven cavity excitation systems for promoting time-averaged uniformity of microwave energy distribution within the cooking cavity, and for improving the impedance matching of the microwave energy generator to the load by reducing the amount of reflected energy returned to the generator.

In a microwave oven cooking cavity, the spatial distribution of the microwave energy tends to be non-uniform. As a result, "hot spots" and "cold spots" are produced at different locations. For many types of foods, cooking results are unsatisfactory under such conditions because some portions of the food may be completely cooked while others are barely warmed. The problem becomes more severe with foods of low thermal conductivity which do not readily conduct heat from the areas which are heated by the microwave energy to those areas which are not. An example of a food falling within this class is cake. However, other foods frequently cooked in microwave ovens, such as meat, also produce unsatisfactory cooking results if the distribution of microwave energy within the oven cavity is not uniform.

A conventionally accepted explanation for the non-uniform cooking pattern is that electromagnetic standing wave patterns, known as "modes," are set up within the cooking cavity. When a standing wave pattern is set up, the intensities of the electric and magnetic fields vary greatly with position. The precise configuration of the standing wave or mode pattern is dependent at least upon the frequency of microwave energy used to excite the cavity and upon the dimensions of the cavity itself. (While it is possible to theoretically predict the particular mode patterns which may be present in the cavity, it should be noted that actual experimental results are not always consistent with theory).

In an effort to alleviate the problem of non-uniform energy distribution, a great many approaches have been tried. The most common approach is the use of a device known as a "mode stirrer," which typically resembles a fan having metal blades. The mode stirrer rotates and may be placed either within the cooking cavity itself (usually protected by a cover constructed of a material transparent to microwaves) or, to conserve space within the cooking cavity, may be mounted within a recess formed in one of the cooking cavity walls, normally the top.

The function of the mode stirrer is to continually alter the mode pattern within the cooking cavity. If a particular mode exists for only a moment, and then is immediately replaced by a mode having different hot and cold spots, then, averaged over a period of time, the energy distribution within the cavity is more uniform. In addition to varying reflection properties, a mode stirrer also tends to "pull" the oscillation frequency of the magnetron (which is a self-oscillating device) about the 2450 MHz center frequency. The cyclical variation in precise operation frequency causes different modes to be theoretically possible in the oven cooking cavity, depending also upon the precise cavity dimensions.

A variation on the mode stirrer approach is to employ a dual feed arrangement with separate mode stirrers or other forms of moving reflector bodies to vary the manner in which microwave energy is introduced into the cavity, with the object generally being to introduce further randomness in the resultant field pattern within the oven cavity, and to even out the energy distribution on a time-averaged basis. By way of example, the following U.S. patents are identified for their disclosures of various dual-feed microwave oven excitation systems: Reftmark's U.S. Pat. No. 3,364,332; Cougoule's U.S. Pat. No. 3,439,143; Wikstrom et al U.S. Pat. No. 3,742,177; Imberg et al U.S. Pat. No. 3,993,886; Thuleen's U.S. Pat. No. 4,133,997; and Baron et al U.S. Pat. No. 4,140,888.

In various refinements to the dual feed approach, individual known fields from a plurality of feed points are combined in a definite manner to predictably produce a resultant field within the microwave oven cavity. The following U.S. patents are identified for their disclosures of this general type of system: White U.S. Pat. No. 3,739,130; Couasnard's U.S. Pat. No. 3,745,292; and Kaneko et al U.S. Pat. No. 4,176,366. A somewhat related disclosure may be found in the commonly-assigned Hauck U.S. Pat. No. 4,144,436, wherein energy is coupled into the cooking cavity through a single cross-shaped opening with two sets of E fields being produced oriented at right angles to each other.

Another consideration in microwave oven design is minimizing load mismatch presented to the microwave energy generator, typically a magnetron, or, stated alternatively, minimizing electromagnetic wave energy reflected back to the generator. This is an especially important consideration where the generator and cooking cavity are relatively closely coupled, and an extremely wide variety of loading conditions may exist in the oven cavity as foods of various quantities and types are placed therein. One prior art approach which, when suitably designed and adjusted, virtually eliminates energy reflected back to the generator, employs an isolator in the form of a directional coupler or microwave circulator to divert reflected wave energy to a microwave absorber, rather than allowing reflected microwave energy to return to the generator. One example of this approach is disclosed in the Nagai U.S. Pat. No. 3,437,777. Another such arrangement is disclosed in the above-referenced Couasnard U.S. Pat. No. 3,745,292. While such arrangements are indeed effective for the purpose of preventing microwave energy generator load mismatch, they introduce complexity and attendant cost into the microwave oven, and additionally are not as efficient because a certain amount of energy is necessarily and deliberately dissipated in a microwave absorber, where the energy is simply converted to heat and not effectively transmitted to the food load being cooked.

From the foregoing brief summary of a variety of approaches to achieving time-averaged uniformity of energy distribution, it will be appreciated that this remains a formidable consideration in the development of practical microwave ovens.

The present invention provides a microwave energy excitation system which advantageously promotes time-averaged uniformity of microwave energy distribution within the cooking cavity and, at the same time, reduces the amount of reflected energy which reaches the microwave energy generator by redirecting this energy towards the food load, rather than by directing it to an absorber.

SUMMARY OF THE INVENTION

Accordingly, it is an object of the invention to provide a microwave oven excitation system which promotes time-averaged uniform energy distribution within a microwave oven cooking cavity.

It is another object of the invention to improve matching of the microwave energy generator, for example a magnetron, to the load, even as various types and quantities of food are placed in the oven cavity to be cooked.

Briefly stated, and in accordance with an important concept of the invetion, electromagnetic wave energy in the form of cooking microwaves is introduced into the cooking cavity with circular polarization. In accordance with the invention, it is recognized that two important features or advantages results with a circularly polarized electromagnetic energy feed, both of these features or advantages resulting from a particular reflection property of circularly polarized electromagnetic waves. Specifically, when a circularly polarized electromagnetic wave is reflected, the direction of rotation is reversed. Incident electromagnetic radiation with right-hand circular polarization is reflected with left-hand circular polarization, and vice versa.

The first important feature or advantage which results from this is that a standing wave pattern with its attendant "hot spots" and "cold spots" is not developed in the direction of the feed. By way of specific example, if circularly polarized microwave energy is introduced through a feed aperture in the top wall of the cooking cavity, and is then reflected from the bottom wall of the cavity, a pronounced standing wave pattern does not develop in the vertical direction, although it does in the two horizontal directions. The reason for this is that a standing wave pattern is normally produced when incident electromagnetic waves flowing towards the load and reflected electromagnetic waves flowing from the load combine to produce a relatively stationary wave pattern with maxima and minima positioned depending upon the precise phasing and intensities of the incident and reflected waves. However, with circular polarization, electromagnetic wave energy reflected from the bottom wall of the cooking cavity is of opposite rotational sense, and does not couple with the incident circularly polarized wave energy. Therefore, a standing wave pattern is not produced. It will be appreciated, however, that in practice perfect circular polarization and direction control is not achieved, and a standing wave pattern to some extent may exist. However, it is less than would otherwise exist.

It will further be appreciated that the example of a top feed with energy reflecting off the bottom cooking cavity wall is exemplary only, and that the circularly polarized feed may equally well be introduced from a side wall of the microwave oven cooking cavity, for reflection from the opposite side wall.

A second important feature or advantage which results from the above-described reflection property of circularly polarized electromagnetic wave energy relates to the reduction of reflected energy which reaches the microwave energy generator, such as the magnetron. In particular, the excitation system preferably includes a feed wave guide extending along the outer surface of one wall of the cooking cavity such that one wall of the wave guide is common with at least a portion of the one wall of the cooking cavity. The microwave energy generator is coupled to the feed wave guide to establish a conventional wave guide mode therein, and the feed wave guide is terminated in at least one reflecting short circuit. A coupling aperture is provided in the common wall between the microwave energy generator and the reflecting short circuit, and also properly located so as to radiate circularly polarized electromagnetic wave energy into the cooking cavity.

In the operation which reduces the amount of reflected energy which is returned to the microwave energy generator, as energy flows from the generator initially past the coupling aperature, any circularly polarized electromagnetic wave energy which is introduced into the cooking cavity through the aperture and which reflects from the opposite cavity wall back through the coupling aperture flows through the wave guide in the same direction as the incident energy, that is on towards the reflecting short circuit. This is due to the particular properties of wave guide apertures which radiate circularly polarized electromagnetic wave energy. This energy returned to the wave guide thus reflects from the reflecting short circuit and again flows past the coupling aperture. Thus, a second opportunity for coupling energy into the cavity is provided, before the reflected energy is returned to the generator. Thus, at least some of the advantageous effect of an isolator comprising a directional coupler and lossy load is realized, without any particular disadvantages.

Another important overall concept in accordance with the invention is the employment of directional antenna beam steering techniques in a microwave oven by shifting the relative phase of energy supplied to a plurality of individual antenna elements in the form of coupling apertures or the like, the phase shifting being accomplished by electronic or other means. Stated alternatively, an important concept of the invention resides in the recognition that electronic beam steering techniques, heretofore employed in antenna design, may advantageously be employed in a microwave oven excitation system.

Preferably, circular polarization is employed in combination with beam steering in order to achieve the features and advantages outlined above which result when circular polarization feed is employed in a microwave oven.

The particular advantage of the beam steering technique is that a beam of high intensity microwave energy may be scanned, either continuously or in discrete jumps, through the cooking cavity volume, to reliably improve the time-averaged uniformity of energy distribution, quite apart from the maxima and minima in electric field intensity which occur as a result of the electromagnetic energy mode pattern which typically exists in a microwave oven cooking cavity.

Briefly stated, and in accordance with a more particular aspect of the invention, an excitation system for a microwave oven cooking cavity having at least a pair of opposed electrically conductive walls includes at least one feed point asociated with one of the cooking cavity opposed walls for introducing circularly polarized microwave energy into the cooking cavity in a direction generally perpendicular to the one of the cooking cavity walls for reflection from the other of the cooking cavity opposed walls. Standing waves are thereby minimized in the direction generally perpendicular to the one of the cooking cavity walls.

Preferably, the excitation system additionally includes a feed waveguide extending along the outer surface of the one wall of the cooking cavity, one wall of the feed waveguide being common with at least a portion of the one wall of the cooking cavity. A microwave energy generator is coupled to the feed wave guide to establish a mode therein, and the feed point is a coupling aperture in the common wall and located with respect to the feed waveguide so as to couple circularly polarized microwave energy into the cooking cavity.

Preferably, the feed waveguide has an end terminal in a reflecting short circuit, and the coupling aperture is positioned between the point at which the microwave energy generator is coupled to the feed waveguide and the reflecting short circuit. As a result, the amount of reflected energy which is returned to the generator is reduced, for reasons set forth above.

Briefly stated, and in accordance with another particular aspect of the invention, a excitation system for a microwave oven cooking cavity includes at least a pair of feed points spaced along one wall of the cooking cavity for introducing microwave energy into the cooking cavity. The excitation system additionally includes an arrangement for providing a plurality of relative phase shifts between the feed points as a function of time. In operation, the electromagnetic energy fields from the feed points combine in the cavity to produce a concentrated beam of energy, the direction of which at any particular time depends upon the particular phase shift between the feed points.

In this arrangement, the relative phase shift between the feed points may either vary continuously as a function of time to produce an essentially infinite number of individual relative phase shifts and a continuously scanning beam, or may vary in discrete steps.

In one particular form of phase shifting arrangement, a feed waveguide extends along the outer surface of the one wall of the cooking cavity, one wall of the feed waveguide being common with at least a portion of the one wall of the cooking cavity. As is frequently employed in conventional practice, the feed wave guide also serves to convey cooling air flow, in addition to microwave energy. In this particular arrangement, a microwave energy generator is coupled to the feed wave guide to establish a mode therein, and the feed points are coupling apertures in the common wall spaced longitudinally along the feed wave guide. A variable phase shifting element in the form of a rotably-mounted dielectric vane is positioned in the feed wave guide so as to be rotated by air flow there through. As the dielectric vane rotates, the velocity of propagation of the electromagnetic energy through the wave guide is varied before it reaches one of the coupling apertures, thereby varying the relative phase of microwave energy coupled from the generator to the coupling apertures.

Briefly stated, and in accordance with still another particular aspect of the invention, an excitation system for a microwave oven cooking cavity includes at least a pair of feed points spaced along one wall of the cooking cavity for introducing microwave energy into the cooking cavity. Each of the feed points introduces circularly polarized electromagnetic wave energy into the cooking cavity. Additionally, there is an arrangement for providing a plurality of relative phase shifts between the feed points as a function of time. As a result, the circularly polarized electromagnetic energy fields from the feed points combine in the cavity to produce a concentrated beam of energy, the direction of which depends upon the particular phase shift between the feed points. As the relative phase shift varies, the beam scans the interior volume of the cooking cavity, producing relatively uniform time-averaged energy distribution within the cooking cavity.

Preferably, a feed waveguide and coupling aperture arrangement as described briefly above are included for supplying the phase-shifted feed points, with an air-rotated variable phase shifting element comprising a rotatably-mounted dielectric vane positioned in the feed waveguide.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DETAILED DESCRIPTION OF THE PREFERRED EMBODIMENTS

Figure 1:
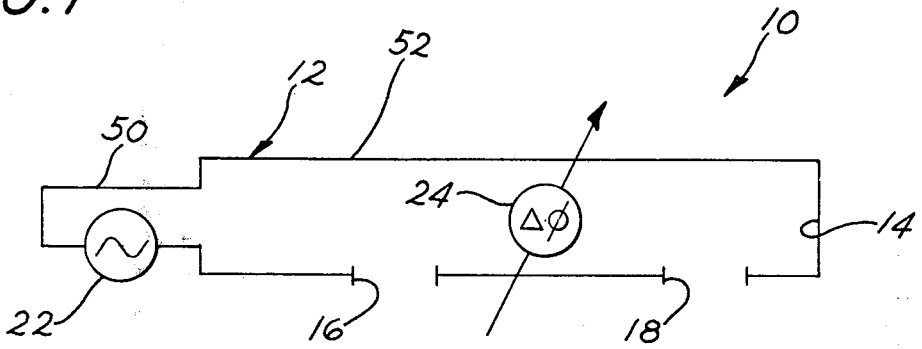
FIG. 1 is a highly schematic representation of a phase shifted, dual-feed, circularly polarized microwave oven cavity excitation system comprising a waveguide in accordance with the invention.

Referring first to FIG. 1, a microwave oven excitation system, generally designated 10, comprises a feed waveguide 12 with a reflecting short circuit end termination 14 and having a pair of coupling apertures 16 and 18 for radiating circularly polarized microwave energy into a cooking cavity 20 (FIG. 2) positioned therebelow. Thus, the apertures 16 and 18 comprise spaced feed points for the cooking cavity 20.

Coupled at one end of the feed waveguide 12 is a microwave energy generator 22 for producing cooking microwaves at any suitable frequency, for example 2450 MHz.

Also shown in FIG. 1 is a variable phase shifting arrangement comprising a variable phase shifting element represented generically at 24 and positioned within the waveguide 12 between the coupling apertures 16 and 18. The phase shifting element 24 may be viewed as a variable time delay device in that it varies the propagation velocity through the waveguide 12 of electromagnetic wave energy supplied to the coupling aperture 18 down stream of the phase shifting element 24. The phase shifting element 24 has little effect on the energy reaching the first coupling aperture 16 from the generator 22. Thus, the relative phase shift between the two apertures 16 and 18 can be varied.

Figure 3:
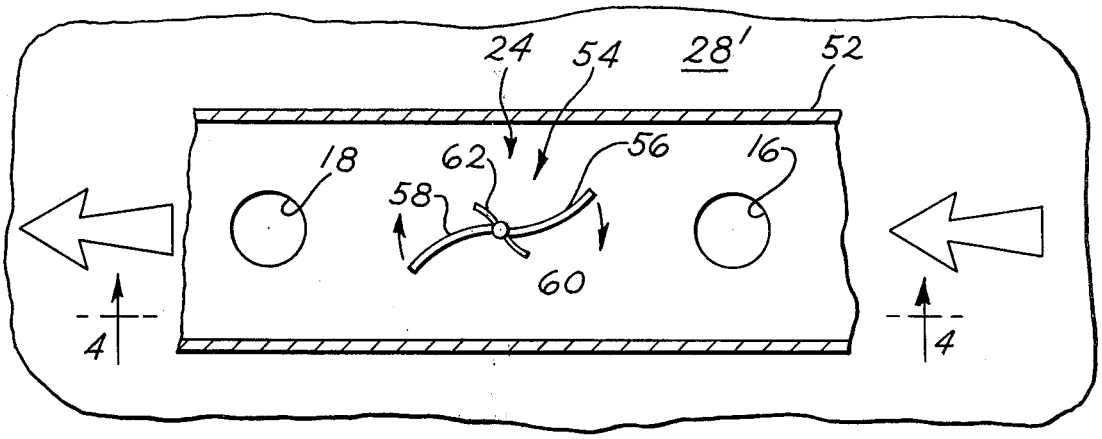
FIG. 3 is a top sectional view taken along line 3—3 of FIG. 2 showing additional details of the feed waveguide, particularly the rotating dielectric vane portion thereof.
Figure 4:
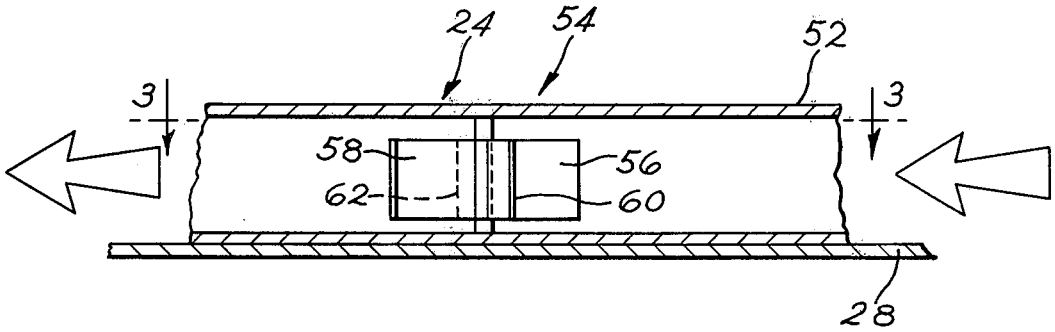
FIG. 4 is a longitudinal section taken along line 4—4 of FIG. 3.
Figure 8:
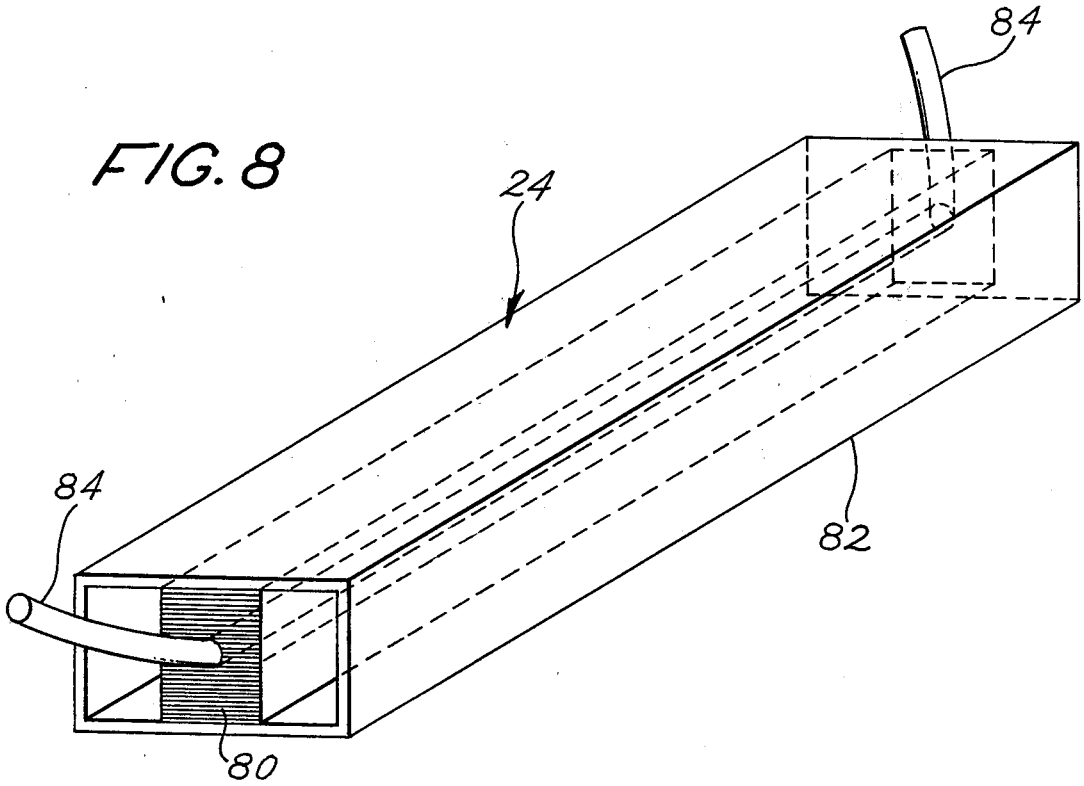
FIG. 8 is a highly schematic isometric view of a waveguide including a digital phase shifting element.

It will be appreciated that a variety of phase shifting elements are known in the art, and accordingly the present invention is not limited to any particular form of phase shifting element. One particular form of variable phase shifting element, described hereinbelow with particular reference to FIGS. 3 and 4, is a rotating dielectric vane. However, electrically controlled digital phase shifting devices comprising a plurality of appropriately selected lengths of ferrite or garnet material may also be employed, such as is illustrated in FIG. 8. Specific materials which may be employed are magnesium-manganese ferrite and yttrium-iron-garnet with aluminum and/or gadolinium substitution for control of saturation moment. Additional information on such digital phase shifting devices may be had by reference to Tech-Brief No. 652 entitled "A Discussion of Ferrite Material Characteristics in Waveguide Digital Phase Shifters", published by Trans-Tech Inc., 12 Meem Avenue, Gaithersburg, Md., and Tech-Brief No. 692 entitled "Ferrite Toroid Reproducibility", also published by Trans-Tech, Inc. The entire disclosures of both of these Tech-Briefs are hereby expressly incorporated by reference. Yet another form of phase shifting element, employing a waveguide stub section and a PIN diode, is described hereinbelow with reference to FIG. 9.

Figure 2:
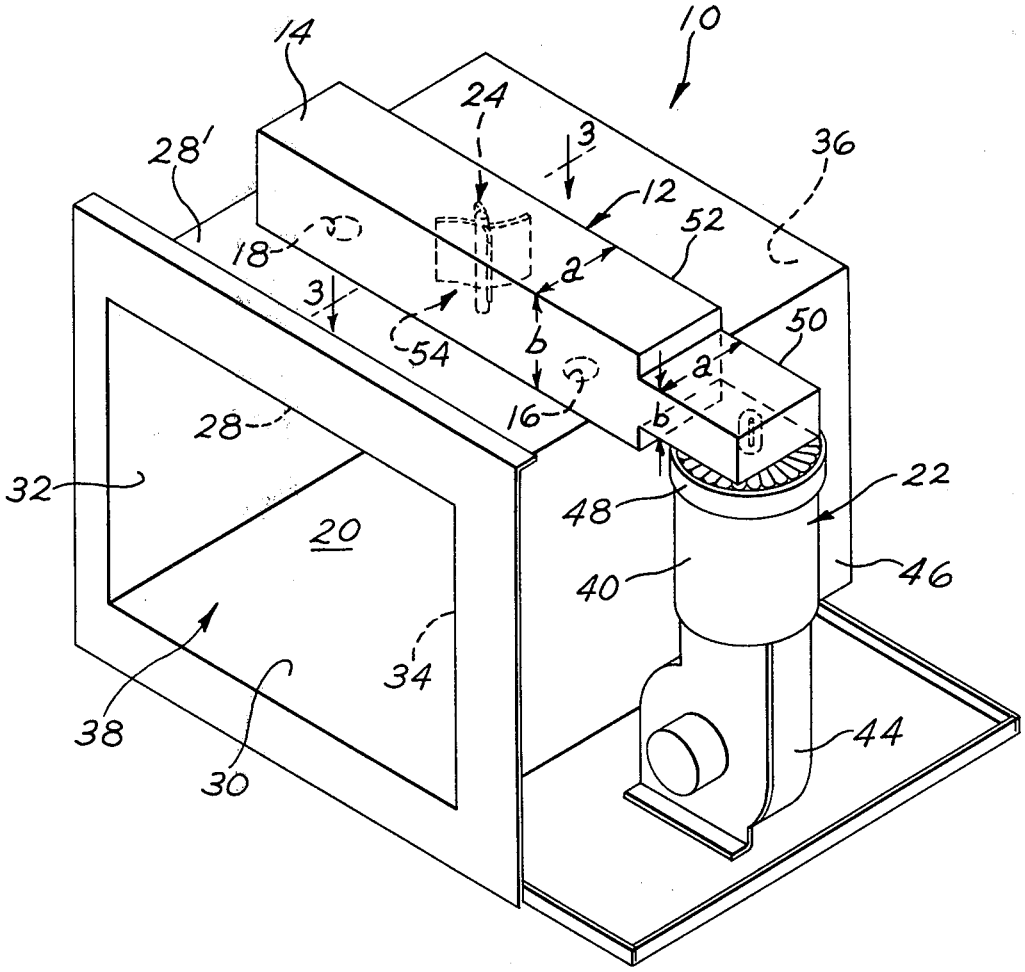
FIG. 2 is a highly schematic isometric view of the feed system of FIG. 1 shown applied to a representative microwave oven cooking cavity, more particularly showing a microwave energy generator in the form of a magnetron and a variable phase shifting element in the form of a rotating dielectric vane.

Referring now in addition to FIG. 1, to FIG. 2, there is shown the general structure of a microwave oven generally designated 26 including the excitation system 10 of FIG. 1. In FIG. 2, the feed waveguide 12 extends along the outer surface 28' of the cavity top wall 28, sharing a common portion therewith. The microwave oven 26, in addition to the excitation system 10, includes the cooking cavity 20 bounded by conductive walls, with a top wall 28 and opposed bottom wall 30, left and right opposed side walls 32 and 34, and a rear wall 36. An access opening 38 is provided, and will be understood to be covered by a conventional access door (not shown) comprising a conductive wall for the cooking cavity 20 and opposed to the rear wall 36. It will be understood that numerous other components, not illustrated, are required in a complete microwave oven, but for clarity of illustration and description, only those elements believed essential for a proper understanding of the present invention are shown and described.

The microwave energy generator 22 of FIG. 1 in FIG. 2 may more particularly be seen to comprise an air-cooled magnetron tube 40 which provides 2450 Mhz microwave energy output at an antenna or probe 42. In connection with the magnetron 40, there are a blower 44 and a cylindrical rubber duct 46 for channeling the air flow over magnetron cooling fins 48. As is conventional in microwave oven practice, the feed waveguide 12 serves the dual functions of conveying microwaves, as well as air flow. Specifically, a portion of the cooling air flow passing from the blower 44 over the magnetron 40 cooling fins 48 passes further through suitable microwave-impermeable apertures into the wave guide 12, through the wave guide 12, and then into the cooking cavity 20 through either the coupling apertures 16 and 18 or other small microwave-impermeable apertures (not shown). Such air flow into the cooking cavity 20 aids in carrying away moisture-laden air, which escapes through conventional microwave-impermeable vent apertures (not shown), and also provides some utilization of magnetron waste heat.

It will be understood that the numerous other components required in a complete microwave oven include control and door interlock circuitry, as well as a high voltage DC power supply for the magnetrons 40. These elements may all be conventional, and as such are well known to those skilled in the art.

In FIGS. 1 and 2, the feed waveguide 12 has two distinct sections 50 and 52 respectively dimensioned so as to propagate $TE_{10}$ mode and $TE_{11}$ mode. In particular, for the wave guide section 50 to which the magnetron antenna 42 couples, the width "a" along the major direction is selected to be slightly more than one-half wavelength, and the height "b" is selected to be less than one-half wavelength, preferably approximately 50% of the "a" dimension.

The waveguide section 50 supporting only the $TE_{10}$ mode couples to the wave guide section 52 which supports a $TE_{11}$ mode. In order for the $TE_{11}$ mode to be supported in the wave guide section 52, both its major dimension "a'" and its minor "b'" are greater than one-half wave length at the 2450 MHz frequency of interest.

Various known arrangements may be provided for introducing circularly polarized electromagnetic wave energy into the cooking cavity 20, and by way of example one arrangement illustrated in FIGS. 1 and 2 will now be described. In particular, the waveguide section 52 is, as mentioned above, appropriately dimensioned so as to support a $TE_{11}$ mode, which implies that two E field vectors are supported, one in the vertical and one in the horizontal direction. In the particular arrangement illustrated, the aspect ratio (a'/b') is made such that these two field vectors have different guide wavelengths and a phase shift therefore occurs between the vectors. The two apertures 16 and 18 are introduced in the wave guide section 52 at points where the two vectors (horizontal and vertical) are 90° out of phase such that a circularly polarized electromagnetic wave is coupled or transmitted into the cooking cavity 20.

The phase shifting element 24 shown generically in FIG. 1 may be seen in FIG. 2, as well as in FIGS. 3 and 4, more particularly to comprise a rotating element 54 including a pair of symmetrically and rotably-mounted dielectric vanes 56 and 58, and auxillary impeller vanes 60 and 62 mounted for rotation about a vertical access by means of shaft bearings 64 and 66 (FIG. 4). The rotating element 54 is so positioned in the wave guide 12 and the vanes 56, 58, 60 and 62 are so configured that the element 54 rotates as air flow produced by the FIG. 2 blower 44 is conveyed through the waveguide 12.

In the operation of this particular form of phase shifting element 24, when the extended vanes 56 and 58 are parallel to the longitudinal dimension of the wave guide section 52 (the orientation being approached in the FIG. 3 depiction), maximum phase delay occurs in the energy being propagated past the phase shift element 24 and to the down stream coupling aperture 18. When the extended vanes 56 and 58 are perpendicular to the longitudinal dimension of the wave guide section 52, minimum phase delay occurs. The phasing of the coupling aperture 16 nearest the generator 22 remains essentially unaffected by the position of the rotating element 54. Thus, as the element 54 rotates, the relative phasing of the apertures 16 and 18 varies to provide a beam steering effect within the cavity 20 depending upon the relative phasing of the fields radiated into the cavity 20 through the apertures 16 and 18.

While one particular form of phase shift element 24 is illustrated herein, it will be appreciated that numerous variations are possible. For example, a separate electric motor may be provided to rotate the element 54, rather than relying upon air flow for rotation. As mentioned hereinabove and illustrated in FIG. 8 described hereinafter, various forms of ferrite or garnet digital phase shifting elements comprising ferromagnetic bodies longitudinally extending within the wave guide section 52, and magnetized in one direction or the other to provide variable phase shifting may be employed. Further, a form employing a PIN diode and a waveguide stub is described hereinafter with reference to FIG. 9.

In the operation of the embodiment described above with reference to FIGS. 1–4, circularly polarized electromagnetic wave energy is radiated from each of the apertures 16 and 18 into the cavity 20 to heat the food load positioned therein. As a result of the circular polarization, a standing wave pattern with attendant nonuniformity is minimized in the cooking cavity 20 vertical dimension for reasons discussed above under the heading "Summary of the Invention."

Also as discussed above, load matching to the magnetron 40 is enhanced because the reflection of electromagnetic energy back to the magnetron 40 is reduced. In particular, incident electromagnetic wave energy conveyed through the wave guide 12 from the magnetron 40 antenna 42 couples through the apertures 16 and 18. Some of this energy reflects from the bottom wall 30 of the cooking cavity 20, and couples back through the apertures 16 and 18 into the waveguide 12. Since the direction of polarization (either right-hand or left-hand) is reversed upon reflection from the cooking cavity bottom wall 30, and due to particular properties of circular polarized coupling apertures, this returned energy continues flowing through the wave guide 12 in the same direction as before, that is towards the reflecting short circuit comprising the end wall 14. This reflected energy then flows in the reverse direction through the wave guide 12, that is, back towards the magnetron 40 antenna 42. However, before reaching the magnetron 40 antenna 42, the energy must again flow past both of the coupling apertures 18 and 16, in that order, and thus is afforded an additional opportunity to couple into the cavity 20.

Concerning the beam steering aspect of the invention, it is well known in the art of directional antenna design that fields from individual antenna elements, depending upon proper phase relationship, combine at points in space beyond the antenna elements to produce resultant fields of maximum and minimum intensity. In accordance with the invention, these principles are applied in a microwave oven to provide, in effect, a steerable beam as a result of the two apertures 16 and 18, with the direction of maximum intensity depending upon the phase relationship between the beams radiated by the apertures 16 and 18, in turn depending upon the position of the phase shifting device 24.

While circularly polarized coupling apertures are employed in the preferred embodiments illustrated and described herein, it will be appreciated that numerous variations are possible within the scope of the invention. For example, more than two radiating elements or feed points may be employed. Similarly, the feed points need not comprise apertures, but may comprise various forms of antenna elements such as probes and dipoles. One such example may be found in an article by Gary G. Sanford, "Conformal Microstrip Phased Array for Aircraft Tests with ATS-6", IEEE Transactions, Vol. AP-26, No. 5, pp. 642–646 (Sept. 1978). This article describes a microstrip phased array which is electronically steerable for use in an aircraft. In accordance with the present invention, the principles of such antennas may be incorporated in a microwave oven excitation system to promote time-averaged uniformity of energy distribution.

Figure 5:
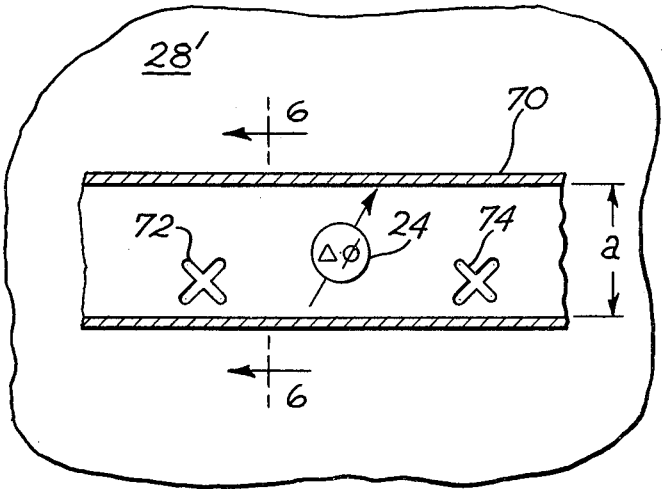
FIG. 5 is a top sectioned view of a feed waveguide including a pair of X-slot coupling apertures for radiating circularly polarized electromagnetic energy into a cooking cavity positioned therebelow.
Figure 6:
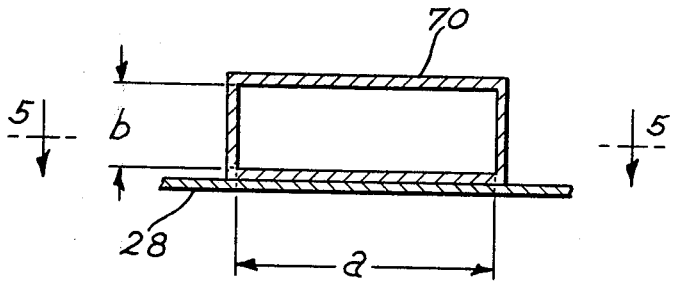
FIG. 6 is a waveguide cross sectional view taken along line 6—6 of FIG. 5 showing the rectangular configuration of the particular form of feed waveguide.

With reference now to FIGS. 5 and 6, there is shown another arrangement by which circularly polarized electromagnetic wave energy may be radiated into a microwave oven cavity for cooking purposes. In particular, FIGS. 5 and 6 illustrate an arrangement in a $TE_{10}$ mode wave guide 70 employing X-slot coupling. In particular, X-slot apertures 72 and 74 are provided in a broad wall of the wave guide 70 common with the top wall 28 of the cooking cavity 20. From FIG. 5, it may be seen that the X-slots 72 and 74 are asymetrically located with respect to the longitudinal center line of the wave guide 70.

The specific manner in which X-slots such as is the slots 72 and 74 radiate circularly polarized electromagnetic radiation is described in detail in an article by Alan J. Simmons, "Circularly Polarized Slot Radiators", *IRE Trans. Antennas and Propagations*, Vol. AP-5, No. 1, pp. 31–36, January, 1957, the entire disclosure of which is hereby expressly incorporated by reference.

This Simmons article explains the reasons why such appropriately located slots in a $TE_{10}$ mode rectangular wave guide radiate circular polarization in the following manner:

The equations for the transverse and longitudinal magnetic fields of the dominant ($TE_{10}$) mode in a rectangular waveguide are:

$$H_x = H_o\sqrt{1-\left(\frac{\lambda}{2a}\right)^2}\ \sin\frac{\pi x}{a}\text{, and}$$

$$H_z = -jH_o\left(\frac{\lambda}{2a}\right)\cos\frac{\pi x}{a},$$

where $H_x$ is the transverse magnetic-field intensity,
$H_z$ is the longitudinal magnetic-field intensity,
$H_o$ is a constant,
$\lambda$ is the free-space wavelength,
a is the waveguide width, and
x is the transverse coordinate.

Two values of x can be found for which $|H_x| = 51$ $H_z|$.

These values or points are given by $$x = \frac{a}{\pi} ctn^{-1}\left[\pm\sqrt{\left(\frac{2a}{\lambda}\right)^2 - 1}\right]$$

At points on the interior broad face of the waveguide 70 for which the equation immediately above holds, the magnetic-field vector, $\vec{H}$, is circularly polarized since the x and z components of this vector are equal in magnitude and in phase quadrature. From the boundary condition, $\vec{J}=\vec{n}\times\vec{H}$, it follows that the vector-current distribution, $\vec{J}$, is likewise circularly polarized at these same points. A small circular hole cut through the wall at such a point accordingly is excited by the circularly polarized current and radiates a circularly polarized wave, right-hand circular from one side of the waveguide and left-hand from the other.

For a wave propagating in the opposite direction, the direction of rotation is reversed and the slot which previously radiated right-hand circular polarization now radiates left-hand and vice versa.

Simmons goes on to point out that, to couple a large amount of power, instead of a circular hole, a pair of narrow radiating slots at right angles to each other may be cut in the waveguide wall, the center of the pair being at the circularly polarized spot. The pair then radiates circular or near-circular polarization. The orientation of the crossed-slot pair is arbitrary, but for convenience may cut at ±45°.

For purposes of comparison, power radiated through a pair of X-slots, for example the aperture 72, is close to 80% when the slots are of a resonant length. In contrast, power radiated from a circular aperture is only 9.5%, according to measurements reported by Simmons.

Accordingly, when an array of X-slot apertures, such as the two apertures 72 and 74 illustrated in FIG. 5, are employed, the slots cannot all be resonant. Otherwise, the aperture nearest the generator 22 would couple most of the available power, leaving little for the other aperture.

Simmons additionally points out that an interesting property of this kind of slot radiator is that of radiating one sense of circular polarization when excited by a wave traveling in one direction in the waveguide and the opposite sense for a wave traveling in the opposite direction. Alternatively, when used as a receiving antenna, an incident wave of right-hand circular polarization will generate a wave traveling toward one end of the waveguide, while an incident left-hand wave will give a wave traveling in the opposite direction toward the other end.

Thus it will be appreciated that the X-slot radiators such as are described by Simmons are quite advantageously employed in microwave oven excitation systems in accordance with the present invention. Not only do they provide a highly effective means of radiating cicularly polarized energy, but they are well adapted for the inventive technique described hereinabove for reducing the amount of reflected energy returned to the generator.

Figure 7:
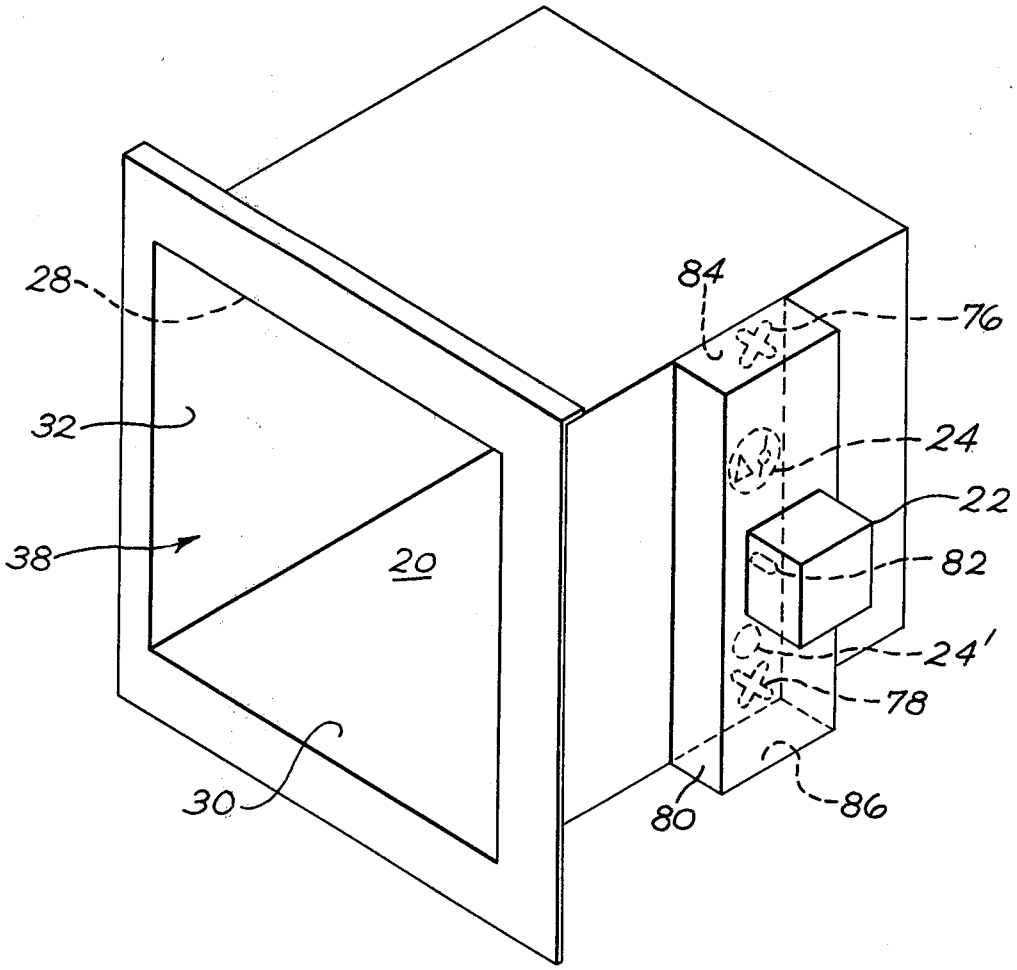
FIG. 7 is a highly schematic isometric view comparable to FIG. 2, but showning an alternative feed arrangement in accordance with the invention.

Referring next to FIG. 7, there is illustrated an alternative form of arrangement in accordance with the invention, which differs from the FIG. 2 arrangement in at least two respects: First, the microwave energy feed points in the form of X-slots 76 and 78 appropriately positioned in a $TE_{10}$ mode wave guide radiate microwave energy into the cavity 20 from the side, specifically from the right-hand side wall 34, toward the opposed left-side wall 32. This allows vertical space to be conserved in the overall oven design, where desired.

Second, the microwave energy generator 22 is not coupled at one end of the wave guide 80, but rather is coupled by means of its antenna 82 to an intermediate portion of the waveguide 80, which then may be considered as having two ends comprising reflecting short circuits 84 and 86, rather than the single reflecting short circuit 14 of FIGS. 1 and 2. In this arrangement, incident microwave energy propagates from the generator 22 in two directions, towards the two coupling apertures 76 and 78. In the same manner as described hereinabove with reference to FIG. 2, reflected energy returned from the cavity 20 back through the apertures 76 and 78 continues on to respective reflecting short circuits 84 and 82, to again flow past the respective apertures 76 and 78, providing another opportunity for coupling to the cavity 20 before reflected energy is returned to the generator 22.

For introducing the necessary variable phase shifting for beam steering, the variable phase shifting element 24 is shown in solid lines positioned between the generator 22 coupling point 82 and the upper X-slot coupling aperture 76. Thus the effective path length between the generator 22 and the coupling aperture 76 is varied as a function of time, while the effective length between the generator 22 and the lower coupling aperture 78 remain essentially constant. Alternatively, the variable phase shifting element may be positioned between the generator 22 and the lower X-slot coupling aperture 78 as indicated by the depiction thereof shown in phantom lines and bearing the reference numeral 24'.

Referring briefly to FIG. 8, there is shown a phase shifting element 24 in the form of an electrically controlled digital phase shifting device such as is described in greater detail in the above-incorporated Tech-Brief No. 652 entitled "A Discussion of Ferrite Material Characteristics in Waveguide Digital Phase Shifters", published by Trans-Tech Inc., 12 Meem Avenue, Gaithersburg, Md. As shown in FIG. 8, such a device comprises one or more appropriately selected lengths of ferrite or garnet material 80 positioned longitudinally in a waveguide 82, with a control current wire 84 for magnetizing the material 80 in one direction or the other.

Figure 9:
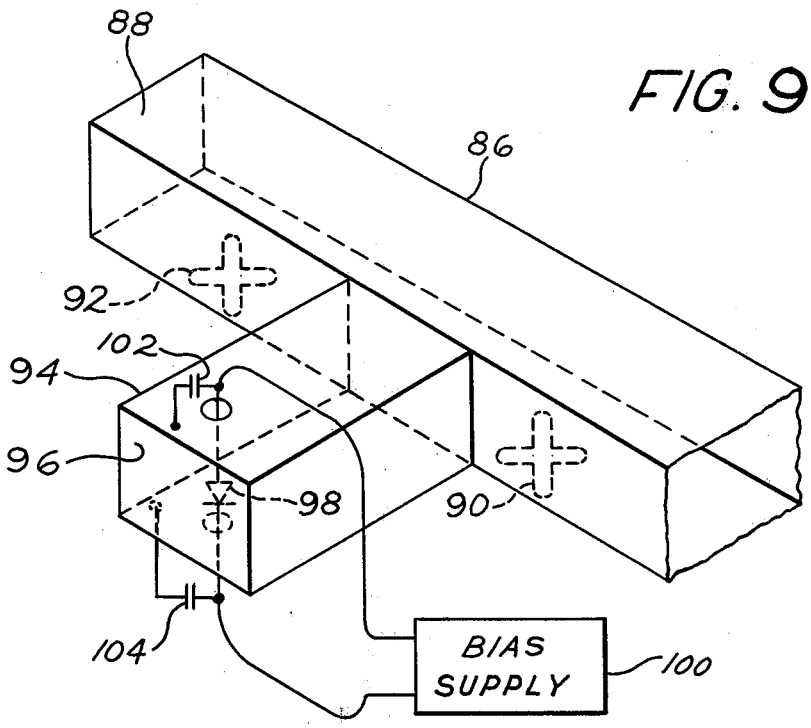
FIG. 9 is a highly schematic isometric view of the waveguide portion only of still another embodiment of the invention including an alternative form of phase shifting element.

Finally, FIG. 9 illustrates another form of phase shifting element 24. While the FIG. 8 phase shifting element 24 is shown applied to a main feed waveguide 86 of the type having a generator (not shown in FIG. 8) coupled at one end and a single reflecting wall 88 at the other, as in FIGS. 1 and 2, it will be appreciated that the form of phase shifting element 24 shown in FIG. 8 may as well be applied to an intermediate feed configuration as in FIG. 7.

In FIG. 9, the variable phase shifting element 24 is positioned between two X-slot apertures 90 and 92 and comprises a waveguide stub section 94 connected in "Tee" configuration to the main feed waveguide 86 and having an end wall 96. Located in the waveguide stub section 94 near the end wall 96 is a switchable shorting rod 98 comprising a PIN switching diode selectively forward and reverse biased by means of a reversible DC bias supply 100. To confine microwave energy within the waveguide stub 94 and to provide a short-circuiting path for microwave energy, RF bypass capacitors 102 and 104 are connected between the PIN diode 98 leads and the waveguide stub 94 walls. The RF bypass capacitors are preferably feedthrough types, and may, for example, have a value of 50 picofarads. Alternatively, one of the PIN diode 98 leads may be directly connected to a waveguide wall and using the waveguide stub 94 as a return conductor, thus eliminating the need for one of the bypass capacitors 102 and 104.

In the operation of the FIG. 9 embodiment, the PIN diode 98 is alternatively forward and reverse biased, thereby in effect selectively providing and removing a short circuit in the waveguide stub 94 altering its reflection characteristics. This in turn varies the effective path length between the apertures 90 and 92 with the same effect as in the previously-described embodiments.

While various specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. An excitation system for a microwave oven cooking cavity, having electrically conductive walls said excitation system comprising:

at least a pair of feed points spaced along one wall of the cooking cavity for introducing microwave energy into the cooking cavity; and an arrangement for providing a plurality of relative phase shifts between said feed points as a function of time;

whereby the electromagnetic energy fields from said feed points combine in said cavity to produce a concentrated beam of energy, the direction of which depends upon the particular phase shift between said feed points.

2. An excitation system according to claim 1, wherein the relative phase shift between said feed points varies continuously as a function of time to produce an essentially infinite number of individual relative phase shifts.

3. An excitation system according to claim 1, wherein the relative phase shift between said feed points varies in discrete steps.

4. An excitation system according to claim 5, which further comprises:

a feed waveguide extending along the outer surface of said one wall of the cooking cavity, one wall of said waveguide being common with at least a portion of said one wall of the cooking cavity, and said feed waveguide serving to convey cooling airflow in addition to microwave energy;

a microwave energy generator coupled to said feed waveguide to establish a mode therein;

said feed points being coupling apertures in said common wall spaced longitudinally along said feed waveguide;

a variable phase shifting element in the form of a rotatably-mounted dielectric vane positioned in said feed waveguide so as to be rotated by airflow therethrough and so as to vary the relative phases of microwave energy coupled from said generator to said coupling apertures.

5. An excitation system according to claim 1, which further comprises:

a feed waveguide extending along the outer surface of said one wall of the cooking cavity, one wall of said waveguide being common with at least a portion of said one wall of the cooking cavity, and said feed waveguide serving to convey cooling airflow in addition to microwave energy;

a microwave energy generator coupled to said feed waveguide to establish a mode therein;

said feed points being coupling apertures in said common wall spaced longitudinally along said feed waveguide;

a variable phase shifting element in the form of an electrically controlled digital phase shifting device positioned in said feed waveguide so as to vary the relative phases of microwave energy coupled from said generator to said coupling apertures.

6. An excitation system according to claim 1, which further comprises:

a feed waveguide extending along the outer surface of said one wall of the cooking cavity, one wall of said waveguide being common with at least a portion of said one wall of the cooking cavity, and said feed waveguide serving to convey cooling airflow in addition to microwave energy;

a microwave energy generator coupled to said feed waveguide to establish a mode therein;

said feed points being coupling apertures in said common wall spaced longitudinally along said feed waveguide;

a variable phase shifting element in the form of a waveguide stub section with a switchable shorting rod including a switching diode positioned in said waveguide stub section, said waveguide stub section being connected to said feed waveguide so as to vary the relative phases of microwave energy coupled from said generator to said coupling apertures depending upon whether said diode is forward or reverse biased.

7. An excitation system for a microwave oven cooking cavity, having electrically conductive walls said excitation system comprising:

at least a pair of feed points spaced along one wall of the cooking cavity for introducing microwave energy into the cooking cavity, each of said feed points introducing circularly polarized electromagnetic wave energy into the cooking cavity; and an arrangement for providing a plurality of relative phase shifts between said feed points as a function of time.

8. An excitation system according to claim 7, which further comprises:

a feed waveguide extending along the outer surface of said one wall of the cooking cavity, one wall of said waveguide being common with at least a portion of said one wall of the cooking cavity;

a microwave energy generator coupled to said feed waveguide to establish a mode therein; and said feed points being coupling apertures in said common wall spaced longitudinally along said feed waveguide, and said feed points being located with respect to said feed waveguide so as to couple circularly polarized microwave energy into the cooking cavity; and wherein said arrangement for providing a plurality of relative phase shifts includes a variable phase shifting element positioned in said feed waveguide so as to vary the relative phase of microwave energy coupled from said generator to said coupling apertures.

9. An excitation system according to claim 8, wherein:

said feed waveguide conveys cooking airflow in addition to microwave energy; and said variable phase shifting element comprises a rotatably-mounted dielectric vane configured for rotation by airflow through said feed waveguide.

10. An excitation system according to claim 7, which further comprises:

a feed waveguide extending along the outer surface of said one wall of the cooking cavity, one wall of said waveguide being common with at least a portion of said one wall of the cooking cavity;

a microwave energy generator coupled to said feed waveguide to establish a mode therein; and said feed points being coupling apertures in said common wall spaced longitudinally along said feed waveguide, and said feed points being located with respect to said feed waveguide so as to couple circularly polarized microwave energy into the cooking cavity; and wherein said arrangement for providing a plurality of relative phase shifts includes an electrically controlled digital phase shifting device positioned in said feed so as to vary the relative phases of microwave energy coupled from said generator to said coupling apertures.

11. An excitation system according to claim 7, which further comprises:

a feed waveguide extending along the outer surface of said one wall of the cooking cavity, one wall of said waveguide being common with at least a portion of said one wall of the cooking cavity;

a microwave energy generator coupled to said feed waveguide to establish a mode therein; and said feed points being coupling apertures in said common wall spaced longitudinally along said feed waveguide, and said feed points being located with respect to said feed waveguide so as to couple circularly polarized microwave energy into the cooking cavity; and wherein said arrangement for providing a plurality of relative phase shifts includes a waveguide stub section with a switchable shorting rod including a switching diode positioned in said waveguide stub section, said waveguide stub section being connected to said feed waveguide so as to vary the relative phases of microwave energy coupled from said generator to said coupling apertures depending upon whether said diode is forward or reverse biased.

12. An excitation system according to claim 8, wherein said feed waveguide has at least one end terminated in a reflecting short circuit, and each of said coupling apertures is positioned between the point at which said microwave energy generator is coupled to said feed waveguide and said at least one reflecting short circuit, whereby any circularly polarized electromagnetic wave energy which is introduced into the cooking cavity through one of said coupling apertures and which reflects from a cooking cavity wall opposite to said one wall of the cooking cavity back through said one of said coupling apertures and is coupled back into said feed waveguide, flows through said waveguide to said at least one reflecting short circuit, and again flows past said one of said coupling apertures, providing a second opportunity for energy to be coupled into the cooking cavity and reducing energy reflected back to said generator.

13. An excitation system according to claim 12, wherein both of said pair of coupling apertures are positioned between the point at which said microwave energy generator is coupled to said feed waveguide and the same reflecting short circuit.

14. An excitation system according to claim 12, wherein each of said pair of coupling apertures is positioned between the point at which said microwave energy generator is coupled to said feed waveguide and respective separate reflecting short circuits.

* * * * *

UNITED STATES PATENT AND TRADEMARK OFFICE

CERTIFICATE OF CORRECTION

PATENT NO. : 4,336,434

DATED : June 22, 1982

INVENTOR(S) : Matthew S. Miller

It is certified that error appears in the above—identified patent and that said Letters Patent is hereby corrected as shown below:

Column 13, Claim 4, line 44, after "claim" delete "5" and insert --2--.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*